US005588739A

United States Patent [19]

Nakao

[11] Patent Number: 5,588,739

[45] Date of Patent: Dec. 31, 1996

[54] FLASHLIGHT WITH SIGNALING LAMP

[75] Inventor: Masashi Nakao, Tokyo, Japan

[73] Assignee: Kyoyu Corporation, Tokyo, Japan

[21] Appl. No.: 356,208

[22] PCT Filed: Mar. 30, 1994

[86] PCT No.: PCT/JP94/00529

§ 371 Date: Dec. 14, 1994

§ 102(e) Date: Dec. 14, 1994

[87] PCT Pub. No.: WO94/27085

PCT Pub. Date: Nov. 24, 1994

[30] Foreign Application Priority Data

May 11, 1993 [JP] Japan ..... 5-133003

[51] Int. Cl.[6] ..... F21L 11/00

[52] U.S. Cl. ..... 362/205; 362/202; 362/208; 362/277

[58] Field of Search ..... 362/187, 202, 362/205, 208, 277, 280, 282, 293, 319, 322; 200/60

[56] References Cited

U.S. PATENT DOCUMENTS

| | | | |
|---|---|---|---|
| 4,345,305 | 8/1982 | Kolm et al. | 362/205 |
| 4,609,976 | 9/1986 | Geissler | 362/202 |
| 5,014,171 | 5/1991 | Price, III | 362/277 |
| 5,205,640 | 4/1993 | Shin | 362/205 |
| 5,412,548 | 5/1995 | Yee | 362/277 |

FOREIGN PATENT DOCUMENTS

| | | |
|---|---|---|
| 549104 | 11/1989 | Australia . |
| 893841 | 4/1991 | Germany . |
| 46-5120 | 2/1971 | Japan . |
| 47-1759 | 1/1972 | Japan . |
| 2209387 | 3/1990 | United Kingdom . |

*Primary Examiner*—Y. Quach
*Attorney, Agent, or Firm*—Ladas & Parry

[57] ABSTRACT

A flashlight with signaling lamp suitable for miniaturization and having good operability is provided. A cylindrical slide body (20) is fitted over the outside of the upper portion of the main body (10) within which a battery is accommodated. When the slide body (20) is slid in upper and lower directions of the figure, the entirety thereof is expanded or contracted. A colorless transparent plate (24) and a reflection plate (25) are provided within an illuminating tubular portion (21). When the entirety is contracted, lamp bulb (40) is positioned within the illuminating tubular portion (21). Thus, this flashlight can be utilized as an illuminating lamp to irradiate the upper direction of the figure. In contrast, when the entirety is expanded, a scattered light by a signaling tubular portion (22) comprised of transparent plastic of red is obtained. Thus, this flashlight can be utilized as a signaling lamp. Inside the signaling tubular portion (22), a groove (22C) is dug. An engagement projection (13C) of the rotary switch (13) is fitted into this groove (22C). By rotation of the slide body (20), the rotary switch (13) is permitted to undergo ON/OFF operation. Thus, the lamp bulb (40) is lighted or turned off.

6 Claims, 11 Drawing Sheets

FLASHLIGHT WITH SIGNALING LAMP

TECHNICAL FIELD

This invention relates to a flashlight (electric torch) with signaling lamp, and more particularly to a flashlight with signaling lamp which can be selectively used either as an illuminating lamp or as a signaling lamp.

BACKGROUND ART

As a handy type illuminating lamp, flashlights have been widely used. In recent years, flashlights with signaling lamp, which have a function as a signaling lamp in addition to a function as a primary illuminating lamp, have been also popularized. Most typical flashlights with signaling lamp have both a function to irradiate white illumination light as a primary illuminating lamp and a function to emit red scattered light as a signaling lamp. Such flashlights with signaling lamp are widely used for the purpose informing traffic means of danger, etc. Particularly, there are many instances where policemen in charge of traffic control always carry such a flashlight with signaling lamp. Lately, there have been carried out attractions such that spectators wave about signaling lamps or signal lights on their heads to give signal during playing at a concert hall to produce atmosphere of the entirety of the concert hall. In such use, signal lights of various kinds of colors including red are utilized.

It is required for the flashlight with signaling lamp to have both functions of illuminating lamp and signaling lamp and to be compact and light in weight as a whole for being handy to carry. For this reason, it is general to utilize a single light source which is used as an illuminating lamp at one time and is used as a signaling lamp at the other time. In view of this, conventional flashlights with signaling lamp employ a structure in which a red transparent body for signaling lamp covers over the side of a lamp bulb to slide a conic-shaped reflection plate in a length direction of the body within the red transparent body. Namely, in the case where such a flashlight with signaling lamp is used as illuminating lamp, the reflection plate is caused to cover over the lamp bulb to irradiate light of the lamp bulb in a length direction of the body instead of in a side direction so that it can be utilized as an illuminating light. On the other hand, in the case where the flashlight is used as a signaling lamp, the reflection plate is caused to be away from the lamp bulb to scatter light of the lamp bulb through the red transparent body provided at the side thereof to emit it toward the outside. When such structure is employed, any one of two functions can be selectively used by movement of the reflection plate.

However, the first problem of the above-described conventional flashlight with signaling lamp is that miniaturization is difficult from a structural point of view. As previously described, in order to permit use as a signaling lamp, it is necessary to provide a red transparent body at the side of the lamp bulb. This red transparent body corresponds to a portion which is observed to luminous red. Accordingly, if this portion is reduced in dimensions, the effect as a signaling lamp is reduced. Thus, it is inevitable to ensure certain dimensions. Since the portion for performing the function as an illuminating lamp is required in addition to the portion for performing the function as a signaling lamp, miniaturization is difficult as a whole.

The second problem of the conventional flashlight with signaling lamp is that operability is poor. Switching between the illuminating lamp and the signaling lamp is carried out by sliding a front end portion within which the reflection plate is accommodated. By the requirement to realize miniaturization for convenience in portability, it is impossible to excessively enlarge the sliding front end portion. For this reason, an operator must slide the small front end portion in upper and lower directions to carry out switching. As a result, operability considerably becomes poor. In addition, since a switch operation for carrying out ON/OFF of lamp bulb is required, operator is required to carry out both switch operation and slide operation until light is caused to be emitted in a desired use state.

With the above in view, an object of this invention is to provide a flashlight with signaling lamp which is suitable for miniaturization and is satisfactory in operability

DISCLOSURE OF INVENTION

A flashlight with signaling lamp according to a first mode of this invention is composed of a main body, and a slide body sliding in a length direction of the main body. The main body includes a tubular casing having a space sufficient to accommodate a battery, a housing for attaching a lamp bulb, and a rotary switch provided between the tubular casing and the housing. Further, the slide body includes an illuminating tubular portion and a signaling tubular portion. A transparent plate is fitted on the upper end surface of the illuminating tubular portion and a reflection plate for irradiating light to the external through the transparent plate is accommodated in the illuminating tubular portion. The signaling tubular portion is comprised of a colored transparent material and connected to the lower end of the illuminating tubular portion. Here, the rotary switch includes a fixed portion fixed at the tubular casing, and a rotary portion rotating with an axis in a length direction of the main body being as axis of rotation, and has a function to constitute a power supply path for delivering power from a battery accommodated within the tubular casing to the lamp bulb by rotating the rotary portion to carry out ON/OFF control of the power supply path. Further, the slide body is attached at the outside of the main body in a direction such that the transparent plate is positioned toward the housing side, so that it slides along the axis in length direction of the main body and can be rotated with the axis in length direction being as axis of rotation, and further includes engagement means for transmitting rotation of the slide body to the rotary portion of the rotary switch.

The second mode of this invention resides in that, in the above-described flashlight with signaling lamp according to the first mode, a groove is formed along in a slide direction inside the signaling tubular portion and an engagement projection is formed at the rotary portion of the rotary switch so that the groove and the engagement projection are fitting-connected to thereby constitute engagement means. When the slide body carries out slide movement, the engagement projection can be moved within the groove, while when the slide body carries out rotary movement, the engagement projection can be moved in a rotational direction by the engagement groove.

The third mode of this invention resides in that, in the above-described flashlight with signaling lamp according to the first mode, a holding tubular portion is connected to the lower end of the signaling tubular portion, whereby when the slide body is slid in an upper direction of the main body, a portion of the holding tubular portion comes into contact with a portion of the main body so that the slide body can be prevented from being pulled out from the main body.

The fourth mode of this invention resides in that, in the above-described flashlight with signaling lamp according to the third mode, the lower portion of the illuminating tubular portion and the upper portion of the signaling tubular portion are screw-connected, and the lower portion of the signaling tubular portion and the upper portion of the holding tubular portion are screw-connected, thus permitting the signaling tubular portion to be exchanged.

The fifth mode of this invention resides in that, in the above-described flashlight with signaling lamp according to the first mode, the rotary switch comprising:

a tubular rotary portion attached to the tubular casing so that the tubular rotary portion can rotate with a center axis of the tubular casing being as axis of rotation, a circuit substrate in the form of plate fixed within the tubular rotary portion so that it is vertical to the axis of rotation, a first conductive spring arranged so that one end is in contact with an electrode for a first polarity formed on a first surface of the circuit substrate, and the other end is in contact with a first polarity terminal of a battery accommodated within the tubular casing, a second conductive spring arranged so that one end is in contact with an electrode for the first polarity formed on a second surface of the circuit substrate and the other end is in contact with a first polarity terminal of the lamp bulb attached to the housing, a first contact arranged so that one end is fixed to the tubular casing and the other portion is placed in contact state or in non-contact state with respect to an electrode for a second polarity formed on the first surface of the circuit substrate in dependency upon rotational position of the tubular rotary portion, and a second contact arranged so that one end is fixed to an electrode for the second polarity formed on the second surface of the circuit substrate, and the other end is electrically connected to a second polarity terminal of the lamp bulb attached to the housing, wherein the tubular casing is constituted with a conductive material, the second polarity terminal of the battery being electrically connected to the tubular casing, and wherein a predetermined wiring is implemented between the electrodes formed on the first surface and the electrodes formed on the second surface of the circuit substrate so that ON/OFF state of the lamp bulb can be controlled by rotating the tubular rotary portion.

The sixth mode of this invention resides in that, in the above-described flashlight with signaling lamp according to the fifth mode, the electrode for first polarity formed on the first surface of the circuit substrate and the electrode for first polarity formed on the second surface thereof are electrically connected, two kinds of electrodes of an electrode for lighting and an electrode for flashing being prepared as the electrode for second polarity formed on the first surface of the circuit substrate, the first contact being adapted to take any one of a first state in contact with the electrode for lighting, a second state in contact with the electrode for flashing, and a third state where the first contact is not in contact with both the electrode for lighting and the electrode for flashing, a flashing circuit for intermittently outputting an inputted power being mounted on the circuit substrate wherein the electrode for flashing is electrically connected to an input terminal of the flashing circuit, and the electrode for lighting and an output terminal of the flashing circuit being electrically connected to the electrode for second polarity formed on the second surface of the circuit substrate.

The flashlight with signaling lamp according to this invention has two important features. The first feature resides in that there is employed a structure to slide the signaling tubular portion along with the illuminating tubular portion. For the purpose of improving the effect as the signaling lamp, it is necessary to allow the signaling tubular portion to be large-sized to some extent. In the present invention, since there is employed such a structure to slide the signaling tubular portion itself, in the case where it is used as illuminating lamp, this signaling tubular portion can be placed in the state covering over the body. Thus, such a flashlight with signaling lamp can become compact as a whole.

The second feature is that a rotary switch is provided as an ON/OFF switch for turning ON/OFF of the lamp bulb. This rotary switch can be rotated by rotation of the slide body. Namely, switching between illuminating lamp and signaling lamp can be carried out by sliding the slide body, and switching between ON-state and OFF-state can be carried out by rotating the slide body. As stated above, all operations can be carried out by the slide body. In addition, since the slide body is large-sized to some extent so as to include the signaling tubular portion, it is easy to grasp or catch such slide body. Thus, operability is improved.

It is to be noted that such a structure to slide the slide body relative to the main body can be realized by fitting an engagement projection formed on the rotary switch into a groove formed inside the signaling tubular portion. Moreover, holding tubular portion is provided below the signaling tubular portion, thereby making it possible to prevent the slide body from being pulled out from the main body. Further, if signaling tubular portion is attached by screw, it is possible to exchange it into any one of signaling tubular portions of various colors.

In addition, if two kinds of positions for continuous lighting operation and intermittent flashing operation are provided as positions of ON-state of the rotary switch, rotational actuation of the slide body permits both the operation for lighting lamp and flashing it.

BEST MODE FOR CARRYING OUT INVENTION

Figure 1:
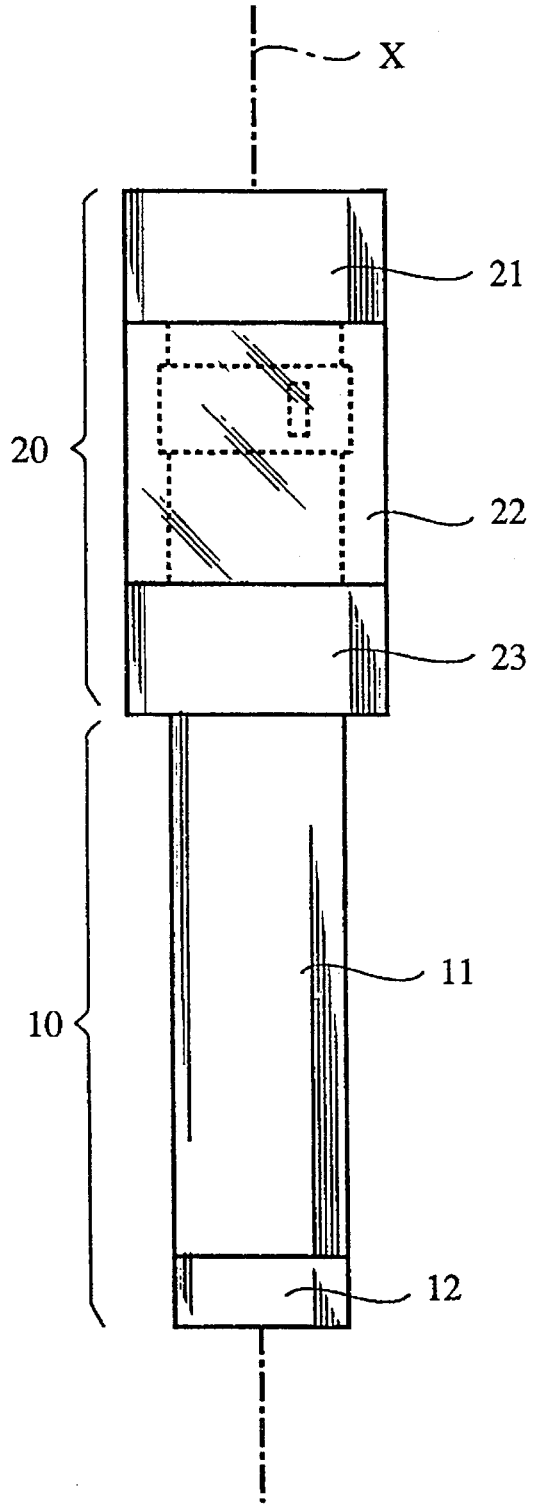
FIG. 1 is a front view of a flashlight with signaling lamp according to an embodiment of this invention.

This invention will now be described in accordance with embodiments shown. FIG. 1 is a front view of a flashlight with signaling lamp according to an embodiment of this invention. This flashlight roughly comprises main body 10 and slide body 20. The main body 10 is tubular as a whole, and a battery or batteries are accommodated within tubular casing 11 serving as the major part thereof. Cover lid 12 is attached on the bottom of the main body 10 in a screw-connecting fashion. By removing this cover lid 12, it is possible to exchange a battery or batteries accommodated therewithin. The slide body 20 is also tubular as a whole, and is composed of three cylindrical portions of illuminating tubular portion 21, signaling tubular portion 22, and holding tubular portion 23 arranged in order from the top. The diameter of the slide body 20 is slightly greater than the diameter of the main body 10, and the slide body 20 is placed in the state where it is fitted over the outside of the upper portion of the main body 10. The main body 10 and the slide body 20 are arranged so as to have a common center axis X, and this center axis X serves as axis in a length direction. It should be noted that, as described later, the slide body 20 slides in a direction of this center axis X relative to the main body 10, and rotates about the center axis X.

The signaling tubular portion 22 is comprised of colored transparent material. In this embodiment, transparent plastic of red is used. Moreover, in this embodiment, the illuminating tubular portion 21 and the holding tubular portion 23 are comprised of opaque plastic, and the tubular casing 11 is comprised of metal. However, these materials are not particularly limited. If the signaling tubular portion 22 is comprised of translucent material, other components may be constituted with any material. It is to be noted that the portion indicated by broken lines in FIG. 1 is a portion of main body 10 which can be seen through the signaling tubular portion 22.

Figure 2:
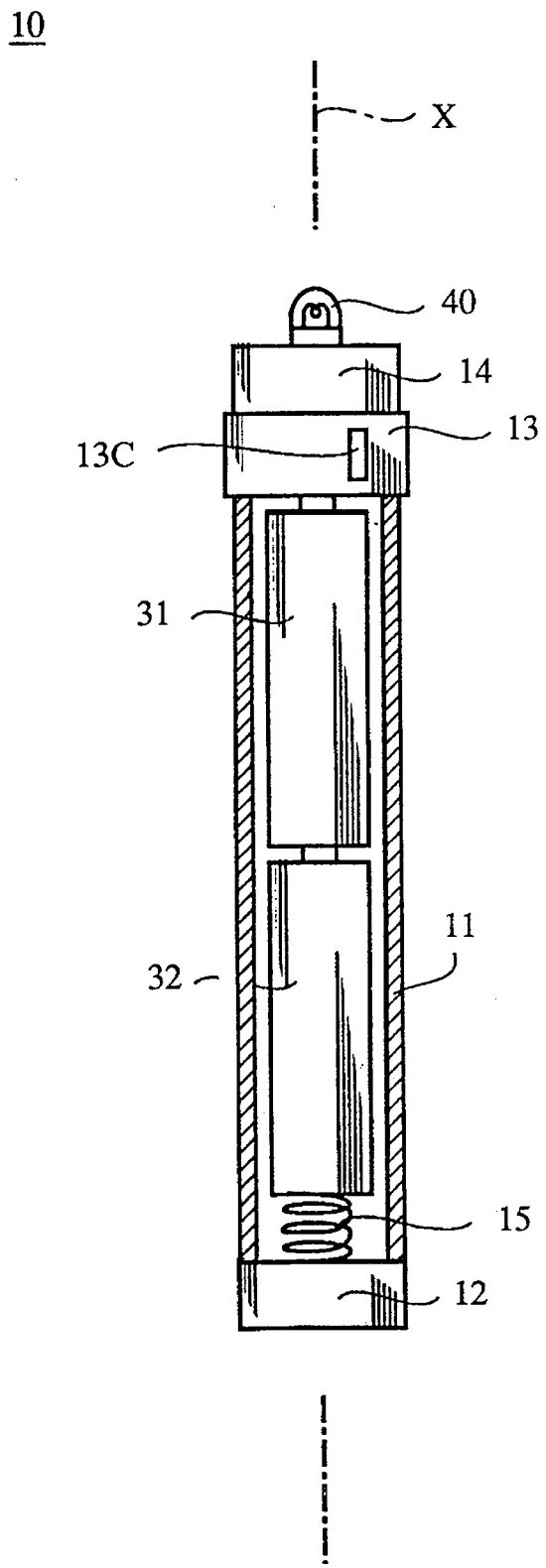
FIG. 2 is a front view showing only the main body 10 of the flashlight shown in FIG. 1, a portion thereof being indicated in cross section.

FIG. 2 is a front view showing only the main body 10 of the flashlight shown in FIG. 1, and a portion thereof is indicated in cross section. As shown in the cross sectional portion, two batteries 31, 32 are accommodated within tubular casing 11. On the tubular casing 11, a columnar rotary switch 13 is attached. Further, on the rotary switch 13, housing 14 is attached. Moreover, lamp bulb 40 is attached on the housing 14. Spring 15 is attached to the cover lid 12. A plus terminal of the battery 31 is in contact with a plus side electrode within the rotary switch 13, and a minus terminal of the battery 32 is in the state in contact with the spring 15. The spring 15 is electrically connected to the tubular casing 11 through the cover lid 12, and the tubular casing 11 is in contact with a minus side electrode within the rotary switch 13. Eventually, the plus side electrode and the minus side electrode within the rotary switch 13 are supplied with power from two batteries 31, 32. As described later, an engagement projection 13C is attached on the side surface of the rotary switch 13.. By rotating this engagement projection 13C about the center axis X, ON/OFF operation of the rotary switch 13 is carried out. Namely, the rotary switch 13 delivers power to the lamp bulb 40 in ON state, but interrupts supply of power in OFF state. Eventually, the lamp bulb 40 is turned ON or OFF by rotating the engagement projection 13C.

Figure 3:
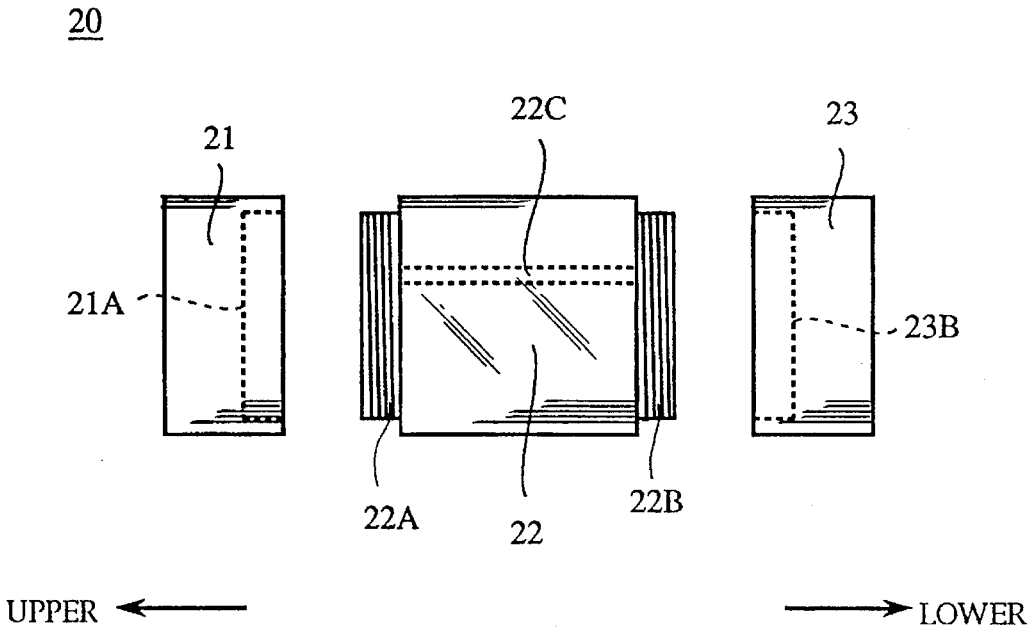
FIG. 3 is a front view showing, in an exploded manner, only the slide body 20 of the flashlight shown in FIG. 1.

FIG. 3 is a front view showing, in an exploded manner, only the slide body 20 of the flashlight shown in FIG. 1. It is to be noted that since the slide body 20 shown in FIG. 1 is indicated in the state where it is laid, it is assumed that "upper" indicates "left" in FIG. 3 and "lower" indicates "right" in. FIG. 3 in the following description. On an internal surface of the lower portion of the illuminating tubular portion 21, female screw 21A is formed. On an external surface of the upper portion of the signaling tubular portion 22, male screw 22A is formed. Similarly, female screw 23B is formed on an internal surface of the upper portion of the holding tubular portion 23, and male screw 22B is formed on an external surface of the lower portion of the signaling tubular portion 22. The slide body 20 is constituted by screw-connecting these three tubular portions 21, 22, 23 in order recited. In addition, groove 22C (indicated by broken lines in FIG. 3) is dug along a length direction of the slide body 20.

Figure 4:
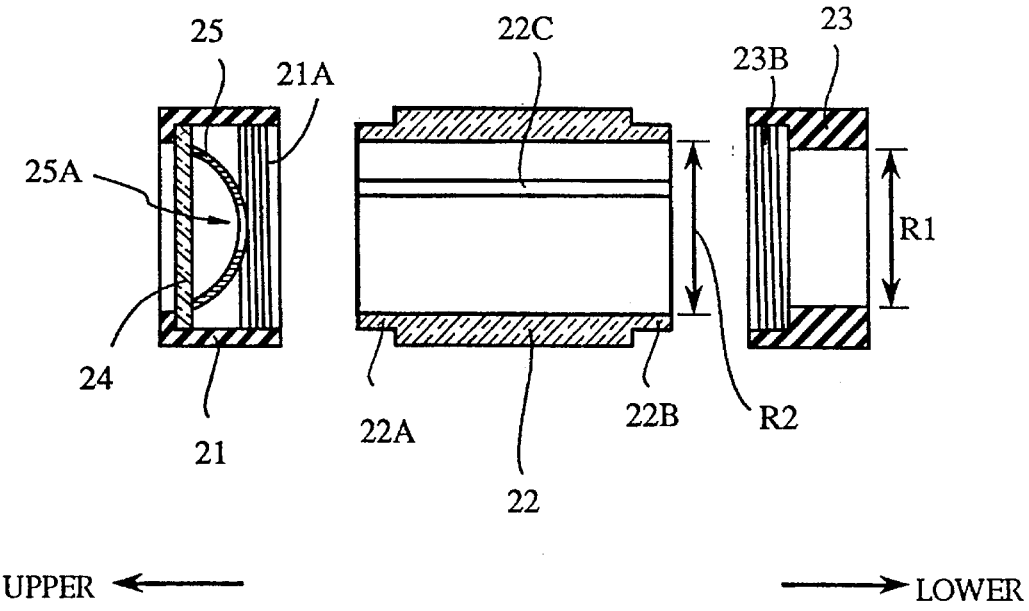
FIG. 4 is a cross sectional view of the slide body 20 shown in FIG. 3.

FIG. 4 is a cross sectional view of the slide body 20 shown in FIG. 3. The illuminating tubular portion 21 is a member used when this flashlight is used as an illuminating lamp, and a disk-shaped transparent plate 24 of plastic is fitted into the upper end surface thereof. A conical reflection plate 25 is disposed below the transparent plate 24. At the central portion of the reflection plate 25, a circular window 25A is formed. As described later, the lamp bulb 40 is conducted through the circular window 25A so that it is located at a predetermined position of the upper portion of the reflection plate 25. On the other hand, as previously described, the groove 22C is formed inside the signaling tubular portion 22. The function of the groove 22C will be described later. The holding tubular portion 23 has a function to prevent the slide body 20 from being pulled out from the main body 10. As previously described, the female screw 23B is formed at the inside of the upper portion of the holding tubular portion 23, but an inner diameter R1 of the lower portion is designed so that it is smaller than the inner diameter R2 of the signaling tubular portion 22. In this embodiment, the inner diameter R2 is substantially equal to the outer diameter of the rotary switch 13 shown in FIG. 2, but the inner diameter R1 is slightly smaller than the outer diameter of the rotary switch 13. Accordingly, even if an attempt is made to fit the slide body 20 over the main body 10 thereafter to slide the slide body 20 in an upper direction to pull out it, at the time point when the holding tubular portion 23 comes into contact with the rotary switch 13, it is unable to slide the slide body 20 in an upper direction above that. Thus, the slide body 20 can be prevented from being pulled out from the main body 10.

Figure 5A:
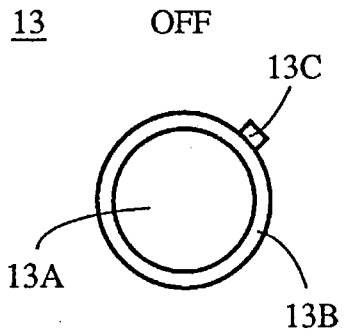
FIGS. 5A to 5D are top views for explaining the function of the rotary switch 13.
Figure 5B:
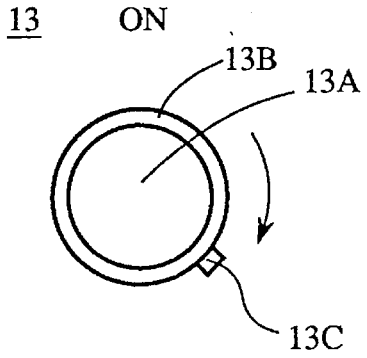
Figure 5C:
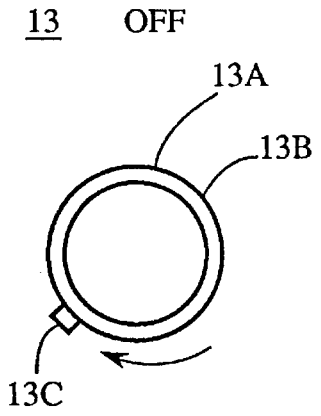
Figure 5D:
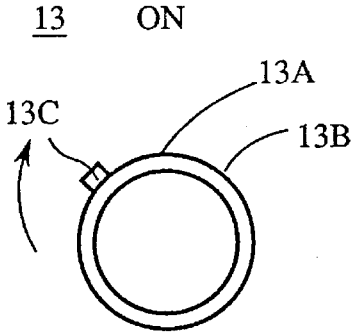

FIGS. 5A to 5D are top views for explaining function of the rotary switch 13. As shown in FIG. 5A, the rotary switch 13 includes fixed portion 13A positioned inside, rotary portion 13B positioned outside, and engagement projection 13C projected from the rotary portion 13B further toward the outside. The fixed portion 13A is fixed on the tubular casing 11, but the rotary portion 13B can be freely rotated around the fixed portion 13A. In actual terms, it is possible to rotate the rotary portion 13B by moving the engagement projection 13C in a direction of outer circumference. The rotary switch 13 carries out ON/OFF operation on the basis of this rotational angle. The rotary switch 13 of this embodiment is of a structure in which ON/OFF state is inverted every time it is rotated by 90 degrees. Namely, assuming that the rotary switch 13 is in OFF state in the state shown in FIG. 5A, it is turned ON in the state shown in FIG. 5B, is turned OFF for a second time in the state shown in FIG. 5C, and is turned ON for a second time in the state shown in FIG. 5D. When the rotary switch 13 is further rotated, the switching state returns to the original state of FIG. 5A. In addition, it is possible to rotate the rotary switch 13 in any direction. As previously described, the lamp bulb 40 is turned ON or OFF on the basis of this ON/OFF operation. It is to be noted that the internal structure of a preferred embodiment with respect to this rotary switch 13 will be described later in detail.

Figure 6A:
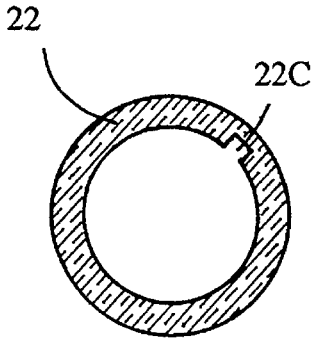
FIGS. 6A, 6B are views showing engagement relationship between the signaling tubular portion 22 and the rotary switch 13.
Figure 6B:
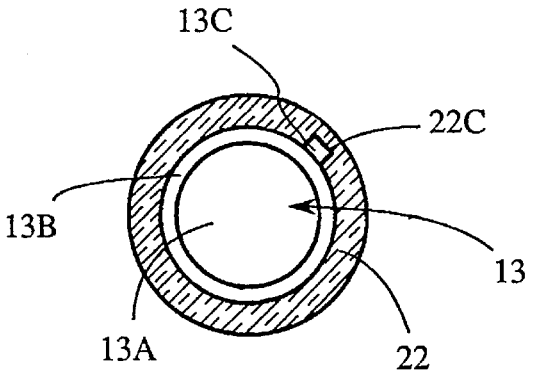

Subsequently, engagement relationship between the rotary switch 13 and the signaling tubular portion 22 will be described. FIG. 6A is an end surface diagram of cut portion when the signaling tubular portion 22 is cut on the plane vertical to a length direction. As previously described, the groove 22C is formed inside. In the state where the slide body 20 is fitted over the main body 10, the signaling tubular portion 22 is fitted over the outside of the rotary switch 13 as shown in FIG. 6B. At this time, the engagement projection 13C of the rotary switch 13 is placed in the state where it is fitted into the groove 22C formed inside the signaling tubular portion 22. In such a structure, the signaling tubular portion 22 can freely slide, irrespective of ON/OFF operation of the rotary switch 13, along the center axis X (direction vertical to the plane surface of paper in FIG. 6B) This is because since the groove 22C is formed along the direction of center axis X, the engagement projection 13C can freely move along the direction of the center axis X within the groove 22C. On the contrary, when signaling tubular portion 22 is rotated about the center axis X, the engagement projection 13C engaged with the groove 22C is also simultaneously rotated. Accordingly, rotary switch 13 carries out ON/OFF operation by rotation of the signaling tubular portion 22. Eventually, in the flashlight shown in FIG. 1, ON/OFF operation for lighting can be made by rotating the slide body 20 about the center axis X.

Figure 7:
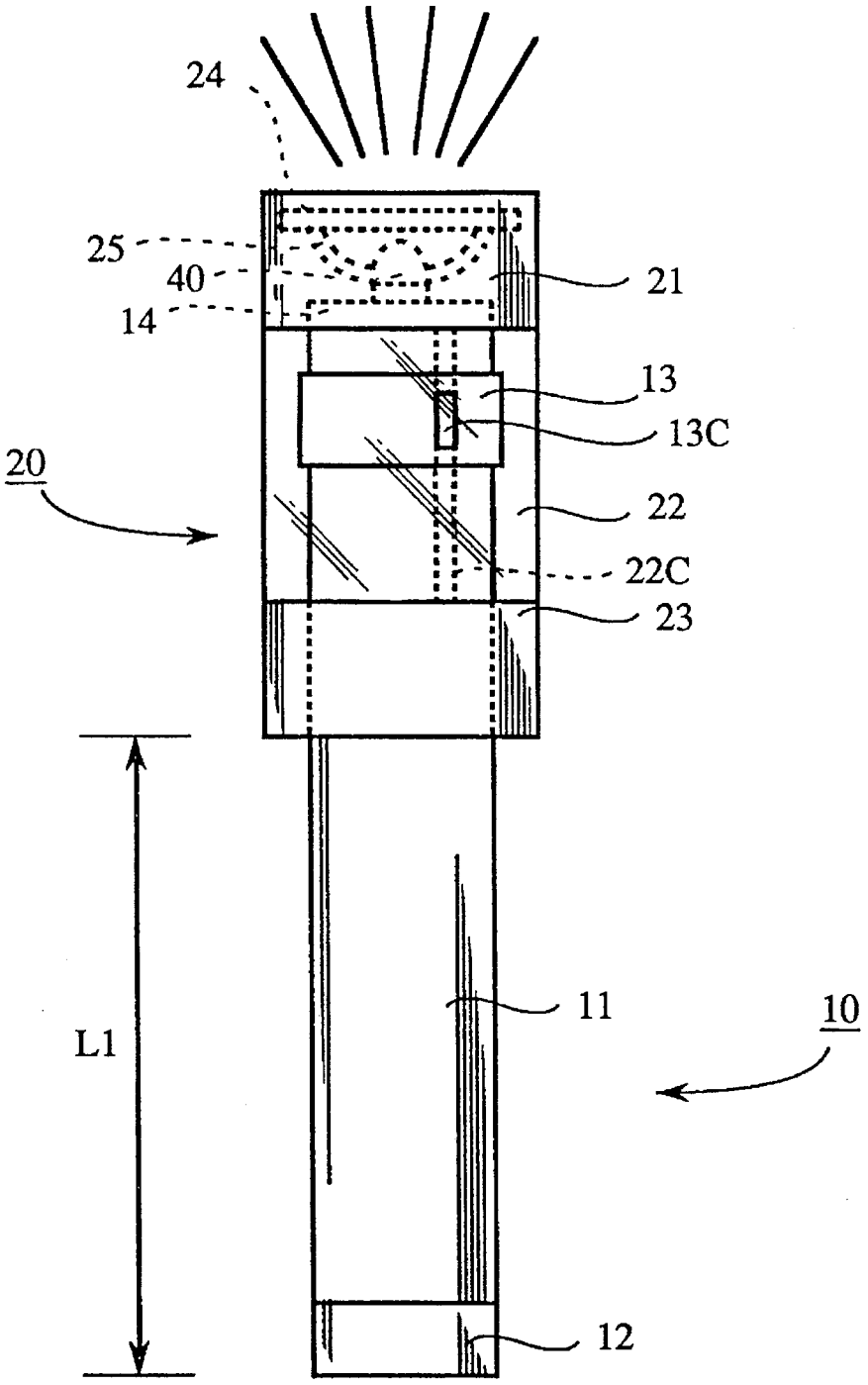
FIG. 7 is a front view showing the state where the flashlight shown in FIG. 1 is turned ON for use as an illuminating lamp.

FIG. 7 is a front view showing the state where this flashlight is turned ON for the purpose of use as an illuminating lamp. By the above described structure, the slide body 20 slides in upper and lower directions of the figure. In the case where the flashlight is used as an illuminating lamp, the slide body 20 is caused to be placed in the state where it is slid to the bottom. The lower end of the slide body 20 is located at the position of distance L1 from the lower end of the main body 10. In this state, since the lamp bulb 40 is positioned within the conical reflection plate 25 as indicated by broken lines in the figure, light from the lamp bulb 40 is reflected on the reflection plate 25, and is irradiated in an upper direction through the transparent plate 24. Namely, this flashlight can be used as an illuminating lamp. Since the lamp bulb 40 is positioned within the illuminating tubular portion 21, no light leaks from the signaling tubular portion 22.

Figure 8:
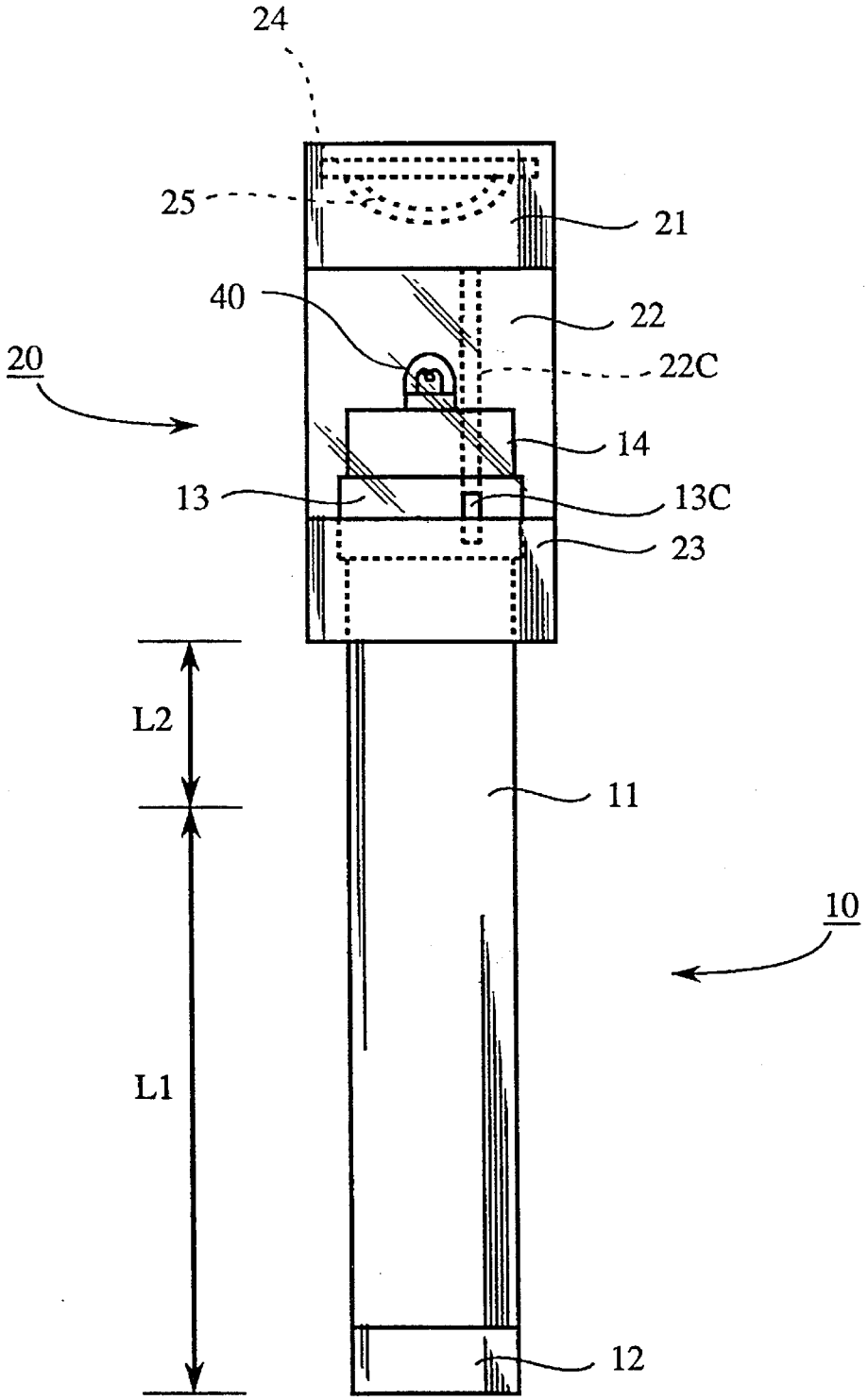
FIG. 8 is a front view showing the state where the flashlight shown in FIG. 1 is turned ON for use as a signaling lamp.

For the purpose of using this flashlight as a signaling lamp, it is sufficient to slide the slide body 20 in an upper direction of the figure. FIG. 8 indicates the state at this time. The lower end of the slide body 20 reaches the position of distance L1+L2 from the lower end of the main body 10. Namely, the entire length of the flashlight is expanded by length L2 by slide operation of the slide body 20. In this state, the lamp bulb 40 is located substantially in the vicinity of the center of the signaling tubular portion 22. Accordingly, light from the lamp bulb 40 is scattered on the entire surface of the signaling tubular portion 22, and is emitted to the external.

For this reason, it is observed that the entirety of the signaling tubular portion 22 shines red. Thus, it is possible to utilize the flashlight as a signaling lamp. As previously described, since the inner diameter of the holding tubular portion 23 is smaller than the diameter of the rotary switch 13, it is impossible to expand the slide body 20 beyond that.

A flashlight with signaling lamp of such a structure becomes very compact. In the state where the flashlight is contracted as shown in FIG. 7, the signaling tubular portion 22 overlaps with the main body 10. As a length of the entirety, this flashlight has substantially the same length as that of the general flashlight having no function as a signaling lamp. As stated above, in the contracted state, the length of the signaling tubular portion 22 is irrespective of the entire length of the flashlight. Accordingly, even if the signaling tubular portion 22 is considerably elongated in order to allow the area of the portion shinning red as a signaling lamp to be large, the entire length of the flashlight remains as it is. Thus, this flashlight is compact and is excellent in portability.

Moreover, a flashlight with signaling lamp of such a structure has very satisfactory operability. Namely, if an operator holds the main body 10 by one hand and holds the slide body 20 by the other hand, he/she can carry out all the operations. When the operator wants to carry out switching between turning ON and turning OFF, it is sufficient to rotate the slide body 20. On the other hand, when the operator wants to carry out switching between an illuminating lamp operation and a signaling lamp operation, it is sufficient to expand or contract the slide body 20. The body 10 and the slide body 20 are both main components of this flashlight. Since the operator can carry out switching of ON/Off and switching of illuminating/signaling lamp by varying these positional relationships, he/she can easily carry out the operation in a dark outdoor place or in a cold environment where movement of finger is dull.

Figure 9A:
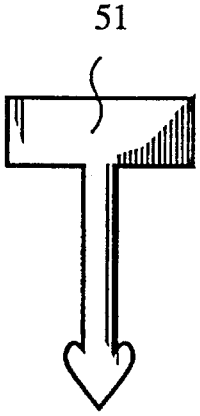
FIGS. 9A to 9D are views showing accessories used in the flashlight shown in FIG. 1.
Figure 9B:
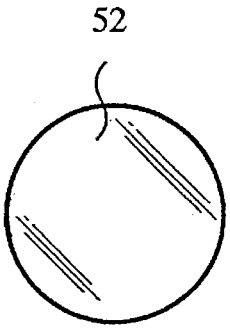
Figure 9C:
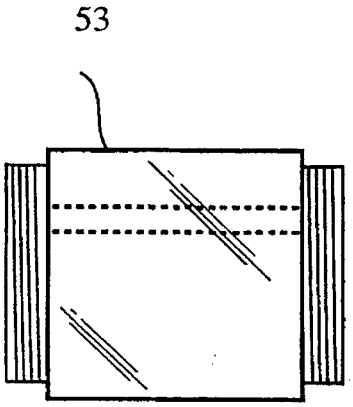

Here, parts suitable to be provided as accessory of the flashlight in the embodiment are enumerated. FIGS. 9A to 9D are views showing several examples of these accessories. In use, clip 51 shown in FIG. 9A is fitted into cover lid 12. By fitting the clip 51, it is possible to carry the flashlight in the state where it is inserted into pocket. Transparent plate 52 for exchange shown in FIG. 9B is used in place of the transparent plate 24. Ordinarily, since white light is used as an illumination light, a colorless or transparent plastic plate is used as the transparent plate 24. For the purpose of permitting utilization as an illuminating lamp with color, it is desirable to provide such transparent plate 52 for exchange as accessory. If a plurality of transparent plastic plates colored by red, blue or yellow, etc. are prepared as the transparent plate 52 for exchange, user can utilize flashlight as an illuminating lamp of desired color. Signaling tubular portion 53 for exchange shown in FIG. 9C is used in place of the signaling tubular portion 22. In the above-described embodiment, the signaling tubular portion 22 is comprised of transparent plastic colored red. When the tubular portion 53 for exchange colored by blue, green or yellow, etc. is provided as an accessory, user can utilize it as a signaling lamp of desired color. Since the signaling tubular portion 22 is attached by screw between the illuminating tubular portion 21 and the holding tubular portion 23, exchange can be extremely easily carried out.

Figure 9D:
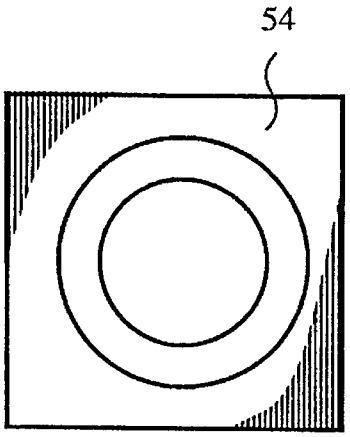
Figure 10:
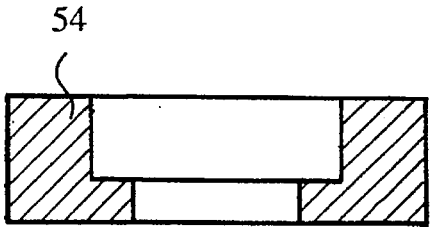
FIG. 10 is a side cross sectional view of the stand 54 shown in FIG. 9D.
Figure 11:
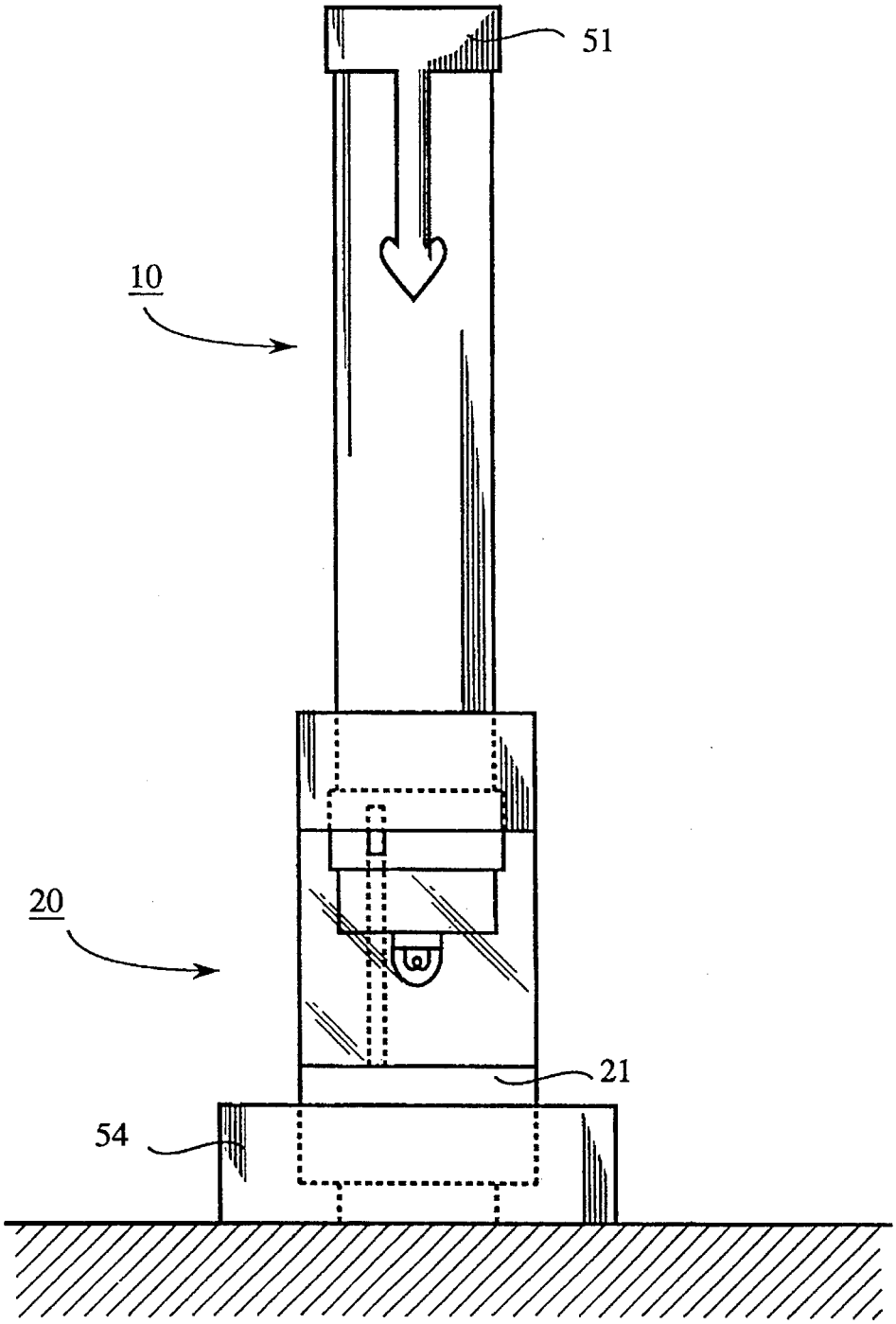
FIG. 11 is a view showing the state where the clip 51 and the stand 54 shown in FIGS. 9A and 9D are used for the flashlight shown in FIG. 1.

Stand 54 shown in FIG. 9D is used for putting up this flashlight on road, etc. As the structure of its cross section is shown in FIG. 10, this stand 54 has a hollowing structure for fitting it into the illuminating tubular portion 21. FIG. 11 is a view showing the state where the clip 51 is attached at this flashlight and the stand 54 is fitted thereto to use it in the state standing on the road. At the time of trouble of an automotive vehicle, or the like, this flashlight is caused to stand on the road by using the stand 54 in this way, thus making it possible to conveniently turn ON the signaling lamp.

Finally, an embodiment of a rotary switch particularly suitable for use in the flashlight according to this invention will now be described. Switching of ON/OFF of the rotary switch 13 in the above-described embodiment is carried out by rotational operation as shown in FIGS. 5A to 5D. Here, an embodiment of a rotary switch capable of carrying out not only such simple ON/OFF switching, but also two kinds of operations of continuous lighting and intermittent flashing will now be described. Namely, if a rotary switch described below is used, the flashlight can take three kinds of states of lighting, flashing and turning off.

Figure 12:
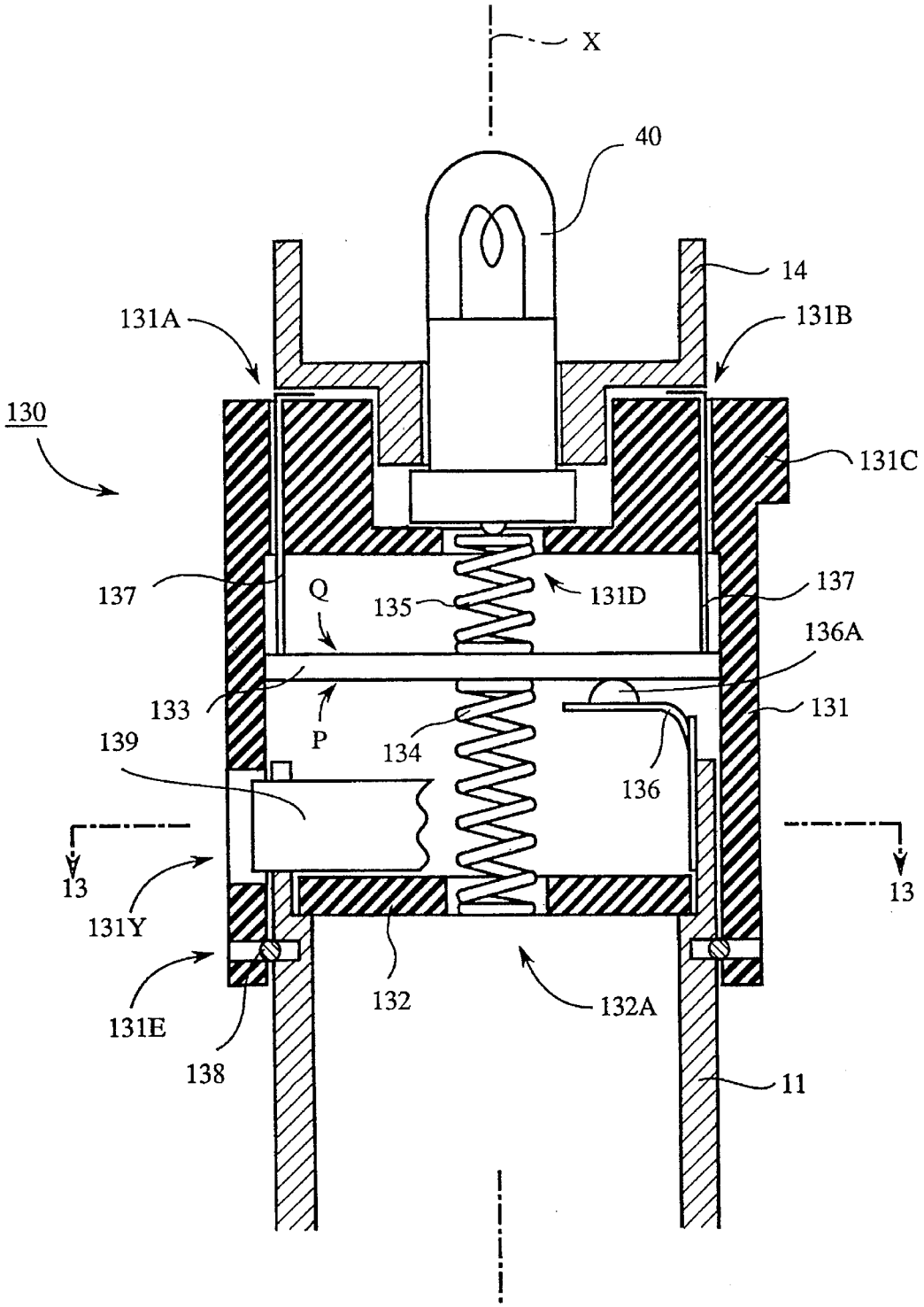
FIG. 12 is a longitudinal cross sectional view showing the structure of the rotary switch 130 having function of switching between lighting operation and flashing operation.

FIG. 12 is a longitudinal cross sectional view showing rotary switch 130 having such three kinds of switching functions and parts related thereto. This rotary switch 130 includes, as the main components, tubular rotary portion 131, cover plate 132, circuit substrate 133, springs 134, 135, contacts 136, 137, fixing shoe 138, and leaf spring 139.

The tubular rotary portion 131 is a cylindrical cap, and its lower portion is fitted over the upper portion of the tubular casing 11. Moreover, wiring slits 131A, 131B are formed at the upper portion of the tubular rotary portion 131, and the contact 137 is inserted through these slits. Further, engagement projection 131C is formed at the outer circumferential portion of the tubular rotary portion 131. This engagement projection 131C corresponds to the engagement projection 13C in the rotary switch 13 referred to in the above-described embodiment, and is fitted into the groove 22C formed inside of the signaling tubular portion 22. On the other hand, opening portion 131D is formed in the center of the upper portion of the tubular rotary portion 131, and the spring 135 is inserted into the opening portion 131D. Fixing slits 131E are slits formed at several portions at the periphery of the tubular rotary portion 131. The fixing shoe 138 comprised of an annular metal wire having an opening at a portion is fitted into the fixing slit 131E and is further fitted into a groove formed at the outer peripheral portion of the tubular casing 11 through the fixing slits 131E. In this way, the tubular rotary portion 131 is attached to the outer circumferential portion of the tubular casing 11 by the fixing shoe 138, and is rotatable relative to the tubular casing 11 with the center axis X of the tubular casing 11 being as axis of rotation. It should be noted that the housing 14 is detachably fixed on the upper surface of the tubular rotary portion 131 by engagement means (not shown). Accordingly, when the tubular rotary portion 131 is rotated about the center axis X, the housing 14 (and the lamp bulb 40) is (are) rotated together.

Cover plate 132 is fixed on the upper portion of the tubular casing 11, and performs function as a stopper for holding batteries 31, 32 accommodated within the tubular casing 11. Opening portion 132A is formed at the central portion of this cover plate 132, and spring 134 is inserted into the opening portion 132A. The lower end of this spring 134 is in contact with the plus terminal of the battery 31 (see FIG. 2) accommodated within the tubular casing 1t.

Circuit substrate 133 is a disk-shaped printed circuit board of bakelite, and has a size substantially in correspondence with the inner circumference of the tubular rotary portion 131. The outer circumferential portion of the circuit substrate 133 is fixed to the inner circumferential portion of the tubular rotary portion 131. The principal surface of the circuit substrate 133 is orthogonal to the center axis X. Spring 134 is fixed on the lower surface P of the circuit substrate 133, and spring 135 is fixed on the upper surface Q. Springs 134, 135 are both comprised of metal, and have conductive property. As previously described, the lower end of the spring 134 is in contact with a plus terminal of the battery 31 through the opening 132A, and the upper end of the spring 135 is in contact with a plus terminal of the lamp bulb 40 through the opening portion 131D. In the state as shown in FIG. 12, a force in a direction to contract the springs 134, 135 is applied thereto. Thus, satisfactory electric contact is obtained with respect to the plus terminal of the battery 31 and the plus terminal of the lamp bulb 40. As described later, the springs 134 and 135 are electrically connected in the circuit substrate 133. Accordingly, the plus terminal of the lamp bulb 40 is electrically connected to the plus terminal of the battery 31 through the springs 134 and 135. It is to be noted that various electrode patterns are formed on the lower surface P and the upper surface Q of the circuit substrate 133, and a circuit using transistors is mounted on the upper surface Q, but is not shown in FIG. 12.

The lower end of the contact 136 is fixed to the tubular casing 11, and the upper end is curved. At the upper surface thereof, a contact bump 136A is formed. This contact bump 136A is a semi-circular metal terminal, and comes into contact with an electrode pattern formed on the lower surface P of the circuit substrate 133. In this embodiment, the tubular casing 11 is metal, and is electrically connected to the minus terminal of battery 32 through the cover lid 12 and the spring 15 (see FIG. 2). In addition, the contact 136 is also metal, and is electrically connected to the tubular casing 11. As a result, the contact bump 136A is placed in the state where it is electrically connected to the minus terminal of the battery 32, and an electrode pattern on the circuit substrate 133 in contact with the contact bump 136A is electrically connected to the minus terminal of the battery 32.

The lower ends of the two contacts 137 are both fixed on the upper surface of the circuit substrate 133, and these two contacts 137 are electrically connected to each other on the circuit substrate 133. These two contacts 137 are respectively extended onto the upper surface of the tubular rotary portion 131 through the wiring slits 131A, 131B, and are in contact with the lower surface of the housing 14. The housing 14 is made up by metal, and is electrically connected to the minus terminal of the lamp bulb 40. As described later, this contact 137 performs function to connect the minus terminal of the battery 32 to the minus terminal of the lamp bulb 40. It is to be noted that while the two contacts 137 are used in this embodiment, it is sufficient to prepare a single contact 137 from a functional point of view.

Figure 13:
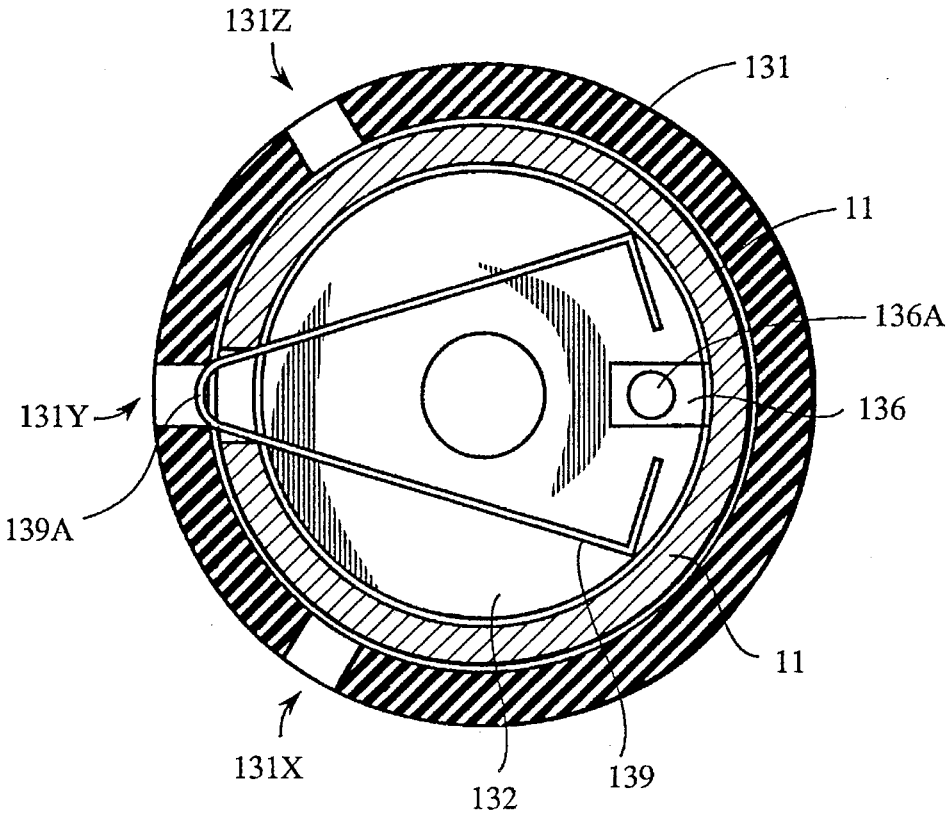
FIG. 13 is a lateral cross sectional view cut along cutting lines 13—13 of the rotary switch 130 shown in FIG. 12.

Subsequently, reference is made to FIG. 13 for the purpose of explaining shape and function of the leaf spring 139. FIG. 13 is a lateral cross sectional view (indication of the spring 134 is omitted) cut along cutting lines 13—13 of the rotary switch 130 and the tubular casing 11 shown in FIG. 12. The leaf spring 139 is a spring of metal substantially V-shaped, and its summit 139A is arranged at a position to project from the opening portion formed in the tubular casing 11 toward the outside. On the contrary, opening portions 131X, 131Y, 131Z are respectively formed at three portions also at the tubular rotary portion 131, and they are all fitted to the summit 139A. The state where the opening portion 131Y is fitted to the summit 139A is shown in FIGS. 12 and 13.

As previously described, the tubular rotary portion 31 is attached to the tubular casing 11 so as to be able to rotate about the center axis X. Let now consider the case where the tubular rotary portion 131 is rotated in a clockwise direction in the state shown in FIG. 13. Since the opening portion 131Y is moved in an upper direction of the figure, the summit 139A is thrust into the inside by the inner circumferential portion of the tubular rotary portion 131. At this time, since the leaf spring 139 has resiliency to some extent, elastic deformation takes place. When the opening 131X is moved to the position of the summit 139A, the summit 139A is placed in the state where it is fitted into the opening portion 131X. In contrast, in the case where the tubular rotary portion 131 is rotated in a counterclockwise direction, the summit 139A is placed in the state where it is fitted into the opening portion 131Z. As stated above, in the state where the summit 139A is fitted into any one of the opening portions 131X, 131Y, 131Z, a force of a certain degree (force sufficient to thrust the summit 139A) is required for rotating the tubular rotary portion 131, resulting in the state where the tubular rotary portion 131 is locked. The role of the leaf spring 139 is to lock the tubular rotary portion 131 at a predetermined rotational position as stated above.

Let confirm, for a second time, the rotational operation of the rotary switch 130 by making reference to FIG. 12. As previously described, when the tubular rotary portion 131 rotates about the center axis X, the housing 14 and the lamp bulb 40 also rotate together. Further, the circuit substrate 133, the springs 134 and 135, and the contact 137 rotate together. On the contrary, since the cover plate 132, the contact 136 and the leaf spring 139 are fixed to the tubular casing 11 side, they do not rotate. Accordingly, the contact bump 136A slides on the lower surface P of the circuit substrate 133 by this rotational operation. In addition, the lower end of the spring 134 also rotates on the plus terminal of the battery 31 (electric contact is maintained satisfactory by expanding/contracting force of spring).

Figure 14:
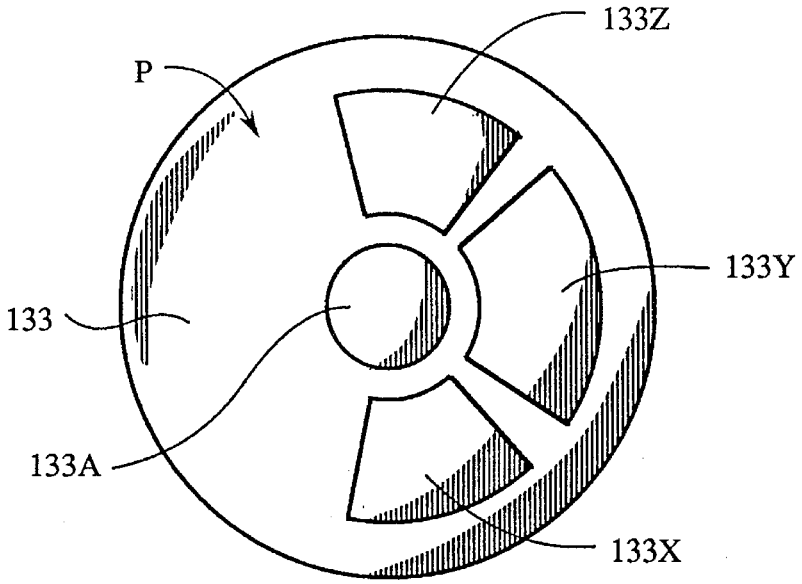
FIG. 14 is a bottom view of the circuit substrate 133 of the rotary switch 130 shown in FIG. 12.

Meanwhile, an electrode pattern as shown in FIG. 14 is formed on the lower surface P of the circuit substrate 133. Namely, circular contact electrode 133A is formed in the center and fan-shaped contact electrodes 133X, 133Y, 133Z are formed therearound. Here, the upper end of the spring 134 is soldered on the circular contact electrode 133A. On the other hand, the contact bump 136A comes into contact with any one of the fan-shaped contact electrodes 133X, 133Y, 133Z in dependency upon a rotational position of the tubular rotary portion 131. Namely, at the rotational position where the summit 139A is fitted into the opening 131X, the contact bump 136A is placed in the state in contact with the contact electrode 133X. At the rotational position where the summit 139A is fitted into the opening portion 131Y, the contact bump 136A is placed in the state in contact with the contact electrode 133Y. At the rotational position where the summit 139A is fitted into the opening 131Z, the contact bump 136A is placed in the state in contact with the contact electrode 133Z.

Figure 15:
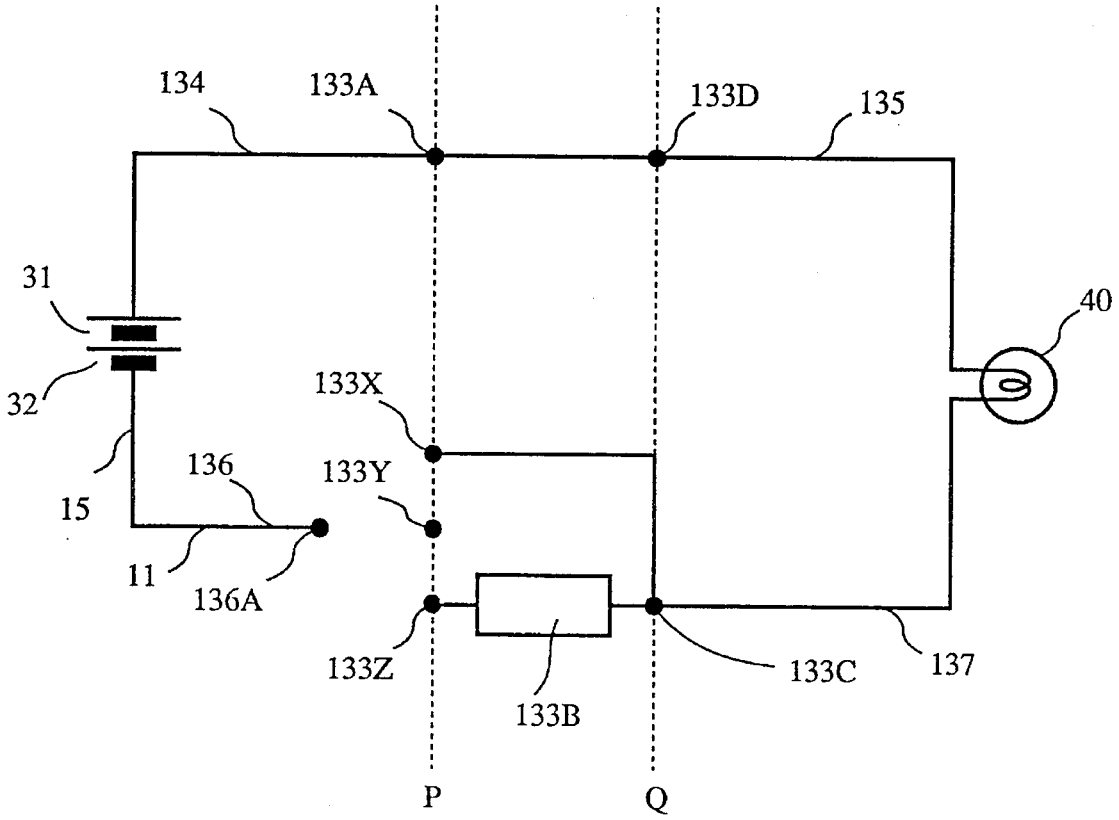
FIG. 15 is a circuit diagram for explaining the operation of the rotary switch 130 shown in FIG. 12.

This circuit substrate 133 is formed as a through-hole substrate. The respective contact electrodes 133A, 133X, 133Y, 133Z formed on the lower surface P are connected to electronic circuits and/or electrodes formed on the upper surface Q. Circuits formed on the circuit substrate 133 are clearly indicated by the equivalent circuit diagram shown in FIG. 15. In this circuit diagram, nodal points 133A, 133X, 133Y, 133Z shown on a broken line P correspond to the respective contact electrodes formed on the lower surface P of the circuit substrate 133, and nodal points 133C, 133D shown on a broken line Q correspond to the contact electrodes formed on the upper surface Q of the circuit substrate 133. Here, the nodal point 133C is electrically connected to the lower end of the contact 137, and the nodal point 133D is electrically connected to the lower end of the spring 135. In addition, flashing circuit 133B is a transistor circuit formed on the upper surface Q of the circuit substrate 133, and has a function to intermittently output inputted power as an ON/OFF manner.

Meanwhile, as previously described, the plus terminal of the battery 31 is electrically connected to the contact electrode 133A through the spring 134, and the contact electrode 133A is electrically connected to the spring 135 through the nodal point 133D. Accordingly, plus power supply is connected to the plus terminal of the lamp bulb 40. On the other hand, the minus electrode of the battery 32 is connected to the contact bump 136A through the spring 15, the tubular casing 11 and the contact 136. Accordingly, when the contact bump 136A comes into contact with the contact electrode 133X, minus power supply is continuously connected to the minus terminal of the lamp bulb 40. When the contact bump 136A comes into contact with the contact electrode 133Z, minus power supply is intermittently connected to the minus terminal of the lamp bulb 40 in an ON/OFF manner through the flashing circuit 133B. Moreover, when the contact bump 136A comes into contact with the contact electrode 133Y, minus power is not delivered to the lamp bulb 40. Eventually, it is possible to control the lamp bulb 40 in dependency upon a rotational position of the tubular rotary portion 131 so that it is placed in three states of lighting, flashing and turning off.

As stated above, the above-described rotary switch 130 includes a flashing (ON/OFF) circuit 133B, and can switch three states of lighting/flashing/turning-off in dependency upon the rotational position. Accordingly, by utilizing this rotary switch 130 for flashlight according to this invention, it is possible to switch three states of lighting/flashing/turning-off also in the case where it is used as an illuminating lamp as shown in FIG. 7, and it is possible to switch three states of lighting/flashing/turning-off also in the case where it is used as a signaling lamp as shown in FIG. 8. In addition, switching of illuminating lamp/signaling lamp can be carried out by slide operation of the slide portion 20. Further, switching of three states of lighting/flashing/turning-off can be carried out by the rotational operation of the slide portion 20. Thus, operability is very excellent.

Figure 16:
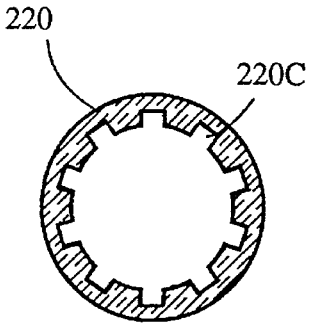
FIG. 16 is a top view of another signaling tubular portion 22 which can be utilized for the flashlight shown in FIG. 1.

While this invention has been described in accordance with the embodiment shown, this invention is not limited to only this embodiment, but may be carried out in various forms in addition to the above. For example, a buttery accommodated within the main body 10 is not limited only to dry battery, but may employ a battery for charging. While the flashlight according to the above-described embodiment is columnar, such a shape may be freely changed from a viewpoint of design. For example, flashlight in the form of square pillar or hexagonal pillar may be employed. Further, engagement means between a rotary switch and a signaling tubular portion is not limited to a groove and an engagement projection as the above-described embodiment. In short, as long as there is employed a structure capable of operating the rotary switch by rotational movement of the slide body while allowing the slide body to ensure free slide movement, any engagement means may be employed. For example, only single groove 22C was formed, as shown in FIG. 6A, in the signaling tubular portion 22 shown in the above-described embodiment. When a large number of grooves 220C are provided at the inner circumferential portion as in the case of the signaling tubular portion 220 shown in FIG. 16, it is possible to enhance the degree of freedom when the signaling tubular portion 220 is fitted over the rotary switch. In addition, it is sufficient for the purpose of enhancing water-proof property to employ structure in which 0 ring is fitted into a necessary portion.

As stated above, in accordance with the flashlight according to this invention, the entirety can become compact, and operability can be improved.

INDUSTRIAL APPLICABILITY

Flashlight with signaling lamp according to this invention can be utilized as various illuminating equipments, and can be utilized also as various signaling equipments. As stated above, since one flashlight serves as both function as an illuminating lamp and function as a signaling lamp, and is compact and is simple in structure. For this reason, such flashlight with signaling lamp is excellent in portability and is suitable for utilization as permanent light for vehicle, etc.

What is claimed is:

1. A flashlight with signaling lamp comprising:

a main body (10) comprising a tubular casing (11) having a space sufficient to accommodate a battery (31, 32), a housing (14) for attaching a lamp bulb (40), and a rotary switch (13, 130) provided between the tubular casing and the housing; and a slide body (20) comprising an illuminating tubular portion (21) and a signaling tubular portion (22, 220), said illuminating tubular portion accommodating a transparent plate (24) which is fitted to an upper end of the illuminating tubular portion and a reflection plate positioned (25) for irradiating light through the transparent plate and said signaling tubular portion having an upper end being connected to a lower end of the illuminating tubular portion and comprised of a transparent material, wherein said rotary switch includes a fixed portion (13A, 132, 136, 139) fixed on the tubular casing and a rotary portion, associated with the slide body, (13B, 131, 133, 134, 135, 137) rotating with a central axis (X) in a length direction of the main body being as axis of rotation and constitutes a power supply path for delivering a power from the battery accommodated within the tubular casing to the lamp bulb, said power supply path being ON/OFF controlled by rotating the rotary portion, and wherein the slide body is a slidably attached to an outside of the main body so that the transparent plate is directed toward the housing and so that said slide body can slide along said central axis and can rotate with said central axis as axis of rotation, said slide body including engagement means (22C, 220C) for transmitting a rotational movement of the slide body to the rotary portion of the rotary switch.

2. A flashlight with signaling lamp as set forth in claim 1, wherein said engagement means is a groove (22c, 220c) formed along a slide direction (X) inside the signaling tubular portion (22, 220) and an engagement projection (13C, 131 C) is formed at the rotary portion of the rotary switch (13, 130), said engagement projection being fitted into said groove, whereby when the slide body (20) carries out a slide movement, the engagement projection is permitted to be moved within the groove, while when the slide body carries out a rotational movement, the engagement projection is permitted to be moved in a rotational direction by the groove.

3. A flashlight with signaling lamp as set forth in claim 1, wherein a holding tubular portion (23) having an upper end connected to a lower end of the signaling tubular portion (22, 220), whereby when the slide body (20) is slid in an upper direction of the main body (10), a portion of the holding tubular portion becomes in contact with a portion of the main body so that the slide body can be prevented from being pulled out from the main body.

4. A flashlight with signaling lamp as set forth in claim 3, wherein a lower portion of the illuminating tubular portion (21) and an upper portion of the signaling tubular portion (22, 220) are screw-connected and a lower portion of the signaling tubular portion and an upper portion of the holding tubular portion (23) are screw-connected, thus permitting the signaling tubular portion to be exchanged with another signaling tubular portion.

5. A flashlight with signaling lamp as set forth in claim 1, the rotary portion comprising:

a tubular rotary portion (131) attached to the tubular casing (11) so as to be able to rotate with respect to the tubular casing with the central axis (X) as axis of rotation;

a circuit substrate (133) in a form of plate fixed in a manner perpendicular to said central axis within the tubular rotary portion;

a first conductive spring (134) arranged so that one end is in contact with an electrode (133A) for a first polarity formed on a first plane (P) of the circuit substrate and another end is in contact with a terminal for the first polarity of a battery (31, 32) accommodated within the tubular casing;

a second conductive spring (135) arranged so that one end is in contact with an electrode (133D) for the first polarity formed on a second plane (Q) of the circuit substrate and another end is in contact with a terminal for the first polarity of the lamp bulb (40) attached to the housing (14);

a first contact (136) arranged so that one end is fixed to the tubular casing (11) and another end is brought into one of two states of contact state and non-contact state with respect to at least an electrode for a second polarity (133X, 133Y, 133Z) formed on the first plane (P) of the circuit substrate in dependency upon a rotational position of the tubular rotary portion; and a second contact (137) arranged so that one end is fixed to an electrode for the second polarity (133C) formed on the second plane (Q) of the circuit substrate, and another end is electrically connected to a terminal for the second polarity of the lamp bulb (40) attached to the housing (14), the tubular casing (11) being constituted with a conductive material, another terminal for the second polarity of the battery being electrically connected to the tubular casing, wirings being implemented between the electrode formed on the first plane of the circuit substrate and the electrode formed on the second plane of the circuit substrate so as to permit lighting state of the lamp bulb to be controlled by rotating the tubular rotary portion.

6. A flashlight with signaling lamp as set forth in claim 5, wherein the electrode for first polarity (133A) formed on the first plane (P) of the circuit substrate and the electrode for first polarity (133D) formed on the second plane (Q) thereof are electrically connected, wherein said at least an electrode for second polarity formed on the first plane of the circuit substrate includes two kinds of electrodes of a lighting electrode (133X) and a flashing electrode (133Z), and the first contact (136) is caused to take, in dependency upon a rotational position of the tubular rotary portion (131), any one of a first state in contact with the lighting electrode, a second state in contact with the flashing electrode, and a third state where it is not in contact with the lighting electrode and the flashing electrode, wherein a flashing circuit (133B) for intermittently outputting an inputted power is mounted on the circuit substrate (133), the flashing electrode being electrically connected to an input terminal of the flashing circuit, and wherein outputs of the lighting electrode and the flashing circuit are electrically connected to the electrode for second polarity (133C) formed on the second plane (Q) of the circuit substrate.

* * * * *